US005833310A

United States Patent [19]

Labelle

[11] Patent Number: 5,833,310

[45] Date of Patent: Nov. 10, 1998

[54] COVER ASSEMBLY FOR A DECK CHAIR

[76] Inventor: André Labelle, 69, avenue Clément, Riviére-Beaudette, Québec, Canada, JOP 1RO

[21] Appl. No.: 695,381

[22] Filed: Aug. 9, 1996

[51] Int. Cl.[6] ..... A47C 7/62

[52] U.S. Cl. ..... 297/184.1; 135/96; 297/184.14

[58] Field of Search ..... 297/184.1, 184.14, 297/184.15, 184.11, 377, DIG. 6; 135/95, 96, 88.11

[56] References Cited

U.S. PATENT DOCUMENTS

| | | | |
|---|---|---|---|
| D. 360,535 | 7/1995 | Sjöberg | D6/335 |
| 2,166,832 | 7/1939 | Wenker | 135/5 |
| 2,752,929 | 7/1956 | Berger | 135/5 |
| 3,404,915 | 10/1968 | De Souza Filho | 297/17 |
| 5,013,085 | 5/1991 | Craig | 297/184 |
| 5,228,749 | 7/1993 | Harrell | 297/408 |
| 5,299,337 | 4/1994 | Venza | 5/656 |
| 5,441,067 | 8/1995 | James et al. | 135/96 |
| 5,449,014 | 9/1995 | Yan-Ho | 135/95 |

*Primary Examiner*—Peter M. Cuomo
*Assistant Examiner*—Stephen Vu
*Attorney, Agent, or Firm*—Birch, Stewart, Kolasch & Birch, LLP

[57] ABSTRACT

The cover assembly is for use with a deck chair having an elongated chair framework with adjoining leg rest, seat and back rest portions. The cover assembly has a roll of fabric which, when unrolled and stretched over the chair framework, is adapted to protectively cover a user lying down on the leg rest, seat and back rest portions. The roll of fabric is rotatably mounted onto a front end of the leg rest portion, transversely with respect to the chair framework, by a shaft extending between a pair of brackets secured to respective sides of the framework. The cover assembly has also a support having a base provided with mounting brackets for upwardly mounting the support onto the chair framework at a remote location away from the roll of fabric, and an upper part shaped to provide at least one attachment point for a free end of an unrolled part of the fabric, at a desired height above the chair framework. The free end of the fabric is fastened to the upper part of the support by means of a suitable fastening element. The deck chair and the cover assembly can be folded together, for easy transportation.

17 Claims, 6 Drawing Sheets

COVER ASSEMBLY FOR A DECK CHAIR

FIELD OF THE INVENTION

The present invention relates to a cover assembly for use with a deck chair having an elongated framework with adjoining leg rest, seat and back rest portions, and a deck chair provided with such a cover assembly.

BACKGROUND OF THE INVENTION

Known in the art is U.S. Pat. No. 5,449,014 (Yan-ho) showing a deck chair convertible into a shelter. The chair has a foldable frame supported by two legs. Two foldable end sections of the frame hold a canvas which, when deployed and attached to support members upwardly connected to the frame, forms a trapezoidal tent entirely covering the top side of the chair. The canvas has a zipped center door extending between the support members, and optional windows extending between the support members and the end sections of the frame.

Also known in the art is U.S. Pat. No. 2,166,832 (Wenker) showing a deck chair provided with a removable sunshade attachment having a vault shape. The attachment consists of two arched frames mounted on the chair close to the front and rear ends thereof, and a fabric sheet extending between the arched frames and slidably secured thereto. The sheet can be withdrawn on a side of the deck chair by sliding it along both arched frames.

Also known in the art are U.S. Pat. Nos. 2,752,929 (Berger) and 5,013,085 (Craig) showing canopy attachments for deck chairs, providing shade protection over the back rests.

Also known in the art are U.S. Pat. Nos. 3,404,915 (De Souza Filho), 5,441,067 (James et al.), 5,228,749 (Harrell), 5,299,337 (Venza) and U.S. design Pat. No. 360,535 (Sjöberg) showing various chair accessories or configurations.

However, none of the above-mentioned documents provides a really practical, easy to use and/or install cover assembly to protectively cover a user lying down on a deck chair.

It is therefore an object of the invention to provide a better and more convenient cover assembly than those mentioned hereinabove.

It is another object of the invention to provide a cover assembly combined with a deck chair, that can be folded together, without the removal of the cover assembly from the deck chair.

SUMMARY OF THE INVENTION

According to the invention, there is provided a cover assembly for use with a deck chair having an elongated chair framework with adjoining leg rest, seat and back rest portions, comprising:

- a roll of fabric which, when unrolled and stretched over the chair framework, is adapted to protectively cover a user lying down on the leg rest, seat and back rest portions;
- means for rotatably mounting the roll of fabric onto a front end of the leg rest portion, transversely with respect to the chair framework;
- a support having a base provided with means for substantially upwardly mounting the support onto the chair framework at a remote location away from the roll of fabric, and an upper part shaped to provide at least one attachment point for a free end of an unrolled part of the fabric, at a desired height above the chair framework; and
- means for attaching the free end of the fabric to the upper part of the support.

According to the invention, there is also provided a deck chair comprising:

- an elongated chair framework with adjoining leg rest, seat and back rest portions; and
- a cover assembly including:
  - a roll of fabric which, when unrolled and stretched over the chair framework, is adapted to protectively cover a user lying down on the leg rest, seat and back rest portions;
  - means for rotatably mounting the roll of fabric onto a front end of the leg rest portion, transversely with respect to the chair framework;
  - a support having a base provided with means for substantially upwardly mounting the support onto the chair framework at a remote location away from the roll of fabric, and an upper part shaped to provide at least one attachment point for a free end of an unrolled part of the fabric, at a desired height above the chair framework; and
  - means for attaching the free end of the fabric to the upper part of the support.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

A detailed description of preferred embodiments of the invention will be given herein below with reference to the following drawings, in which like numbers refer to like elements. In the drawings.

DETAILED DESCRIPTION OF THE PREFERRED EMBODIMENTS

Figure 1:
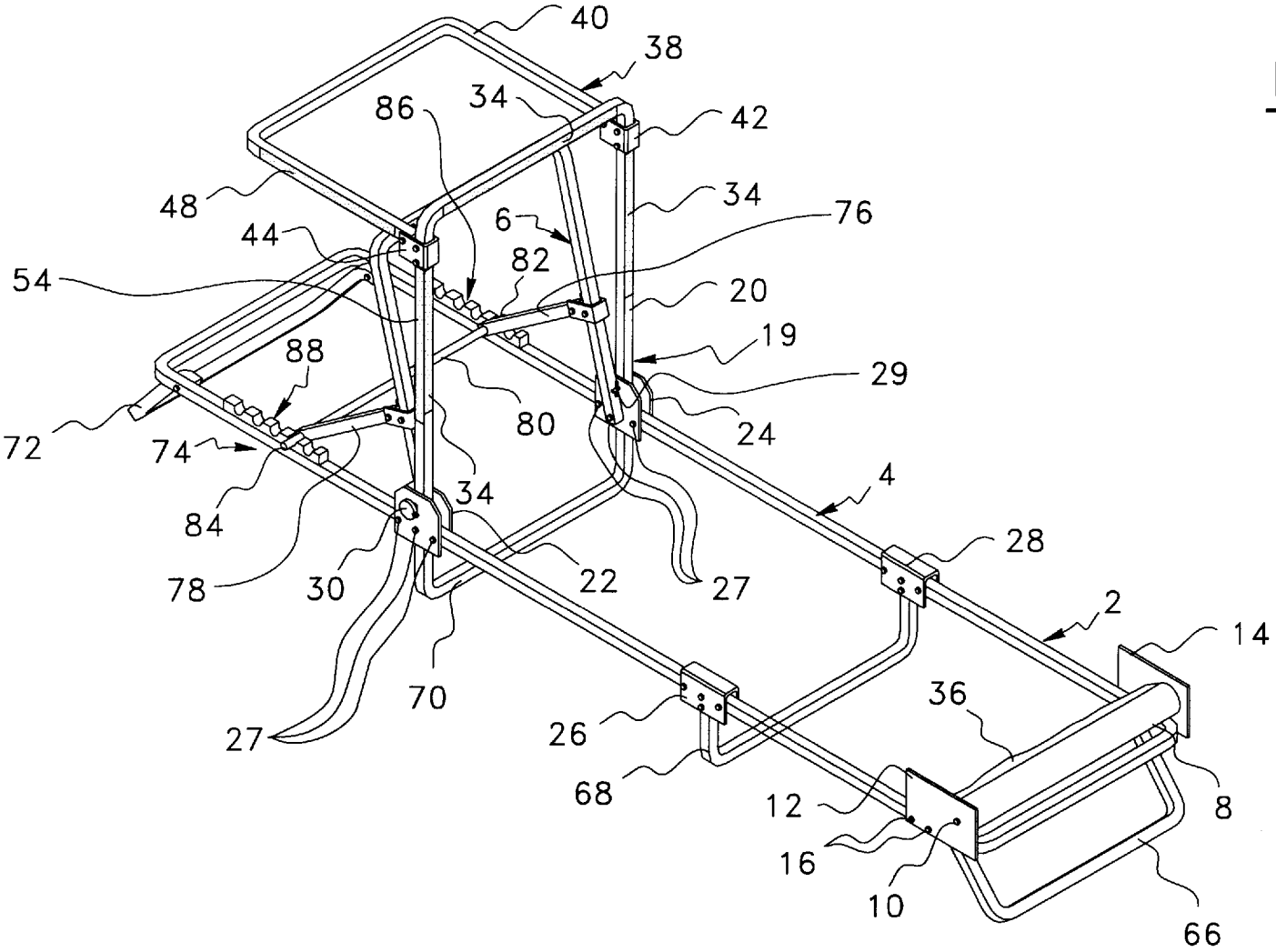
FIG. 1 is a perspective view illustrating a deck chair framework provided with a cover assembly according to the invention.
Figure 2:
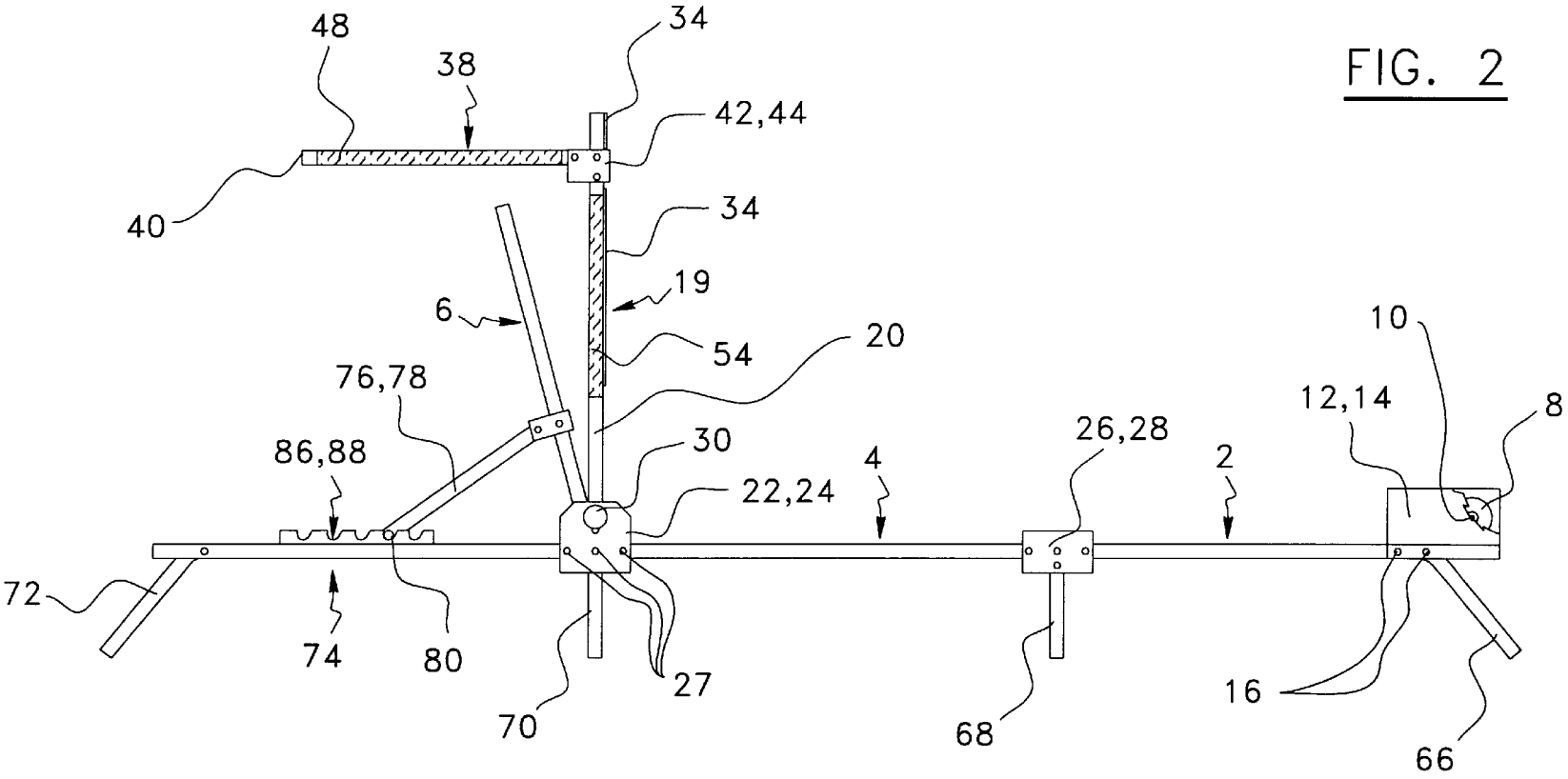
FIG. 2 is a side elevation view of the deck chair as shown in FIG. 1.

Referring to FIGS. 1 and 2, there is shown an elongated deck chair framework with adjoining leg rest, seat and back rest portions 2, 4, 6, provided with a cover assembly according to the invention. The cover assembly is particularly useful to protect a user lying down on the deck chair from sun rays, rain and wind whatever their origin with respect to the chair. It will become apparent from the following description that the cover assembly is designed so that it can be either added to an existing deck chair or integrated therewith during its manufacturing, and that it combines with the chair framework to form an easily portable, foldable arrangement.

The cover assembly basically comprises a roll of fabric 8 which, when unrolled and stretched over the chair framework, is adapted to protectively cover a user lying down on the leg rest, seat and back rest portions 2, 4, 6. The roll of fabric 8 is rotatably mounted onto a front end of the leg rest portion 2, transversely with respect to the chair framework, by means of a rotatable shaft 10 extending between upper portions of roll supporting brackets 12, 14. The roll supporting brackets 12, 14 have lower portions secured onto respective sides of the chair framework by means of bolts 16. Any other convenient securing elements could also be used to secure the roll supporting brackets 12, 14. The brackets 12, 14 can take any suitable shape, and could be solid with the chair framework if the deck chair is initially manufactured with the cover assembly.

Figure 6:
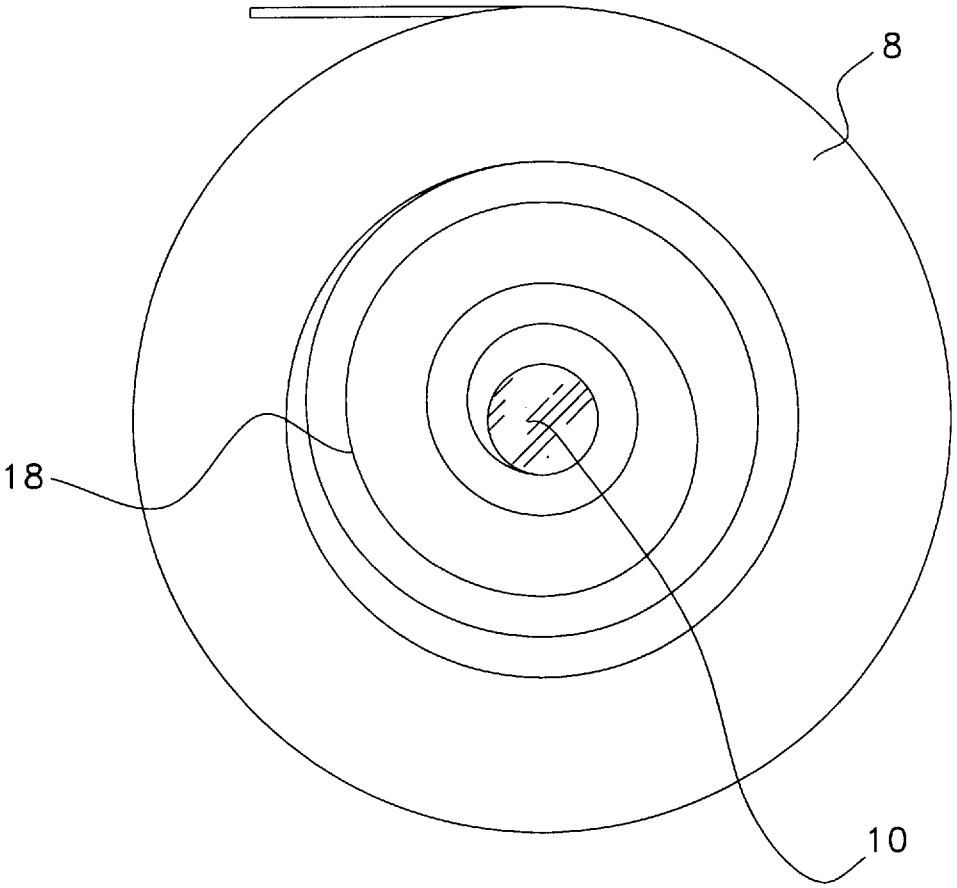
FIG. 6 is a cross-sectional view of a roll of fabric mounted onto a shaft provided with a rewind mechanism.

Referring to FIG. 6, the shaft 10 can be conveniently provided with a rewind mechanism 18 like in a blind, causing the roll of fabric 8 to automatically rewind when not stretched. Otherwise, the user would have to rewind the roll of fabric 8 using a suitably arranged crank or in a direct manual manner.

Referring back to FIGS. 1 and 2, the cover assembly also basically comprises a support 19 in the form of a U-shaped support pole 20 having lower ends forming the base of the support 19, on respective sides of the chair framework. The lower ends of the support pole 20 are pivotally connected to upper portions of mounting brackets 22, 24 having lower portions secured onto respective sides of the framework at or near the junction of the seat portion 4 with the back rest portion 6, by means of bolts 27.

The support pole 20 is locked in a fixed angular position with respect to the seat portion 4 by means of a pair of cotters 29 inserted in coaxially alignable bores through the lower ends of the support pole 20 and the upper portions of the mounting brackets 22, 24, shifted from a pivot axis of the support pole 20 with respect to the mounting brackets 22, 24. The cotters 29 are provided with a handle 30 to facilitate their use.

Figure 3:
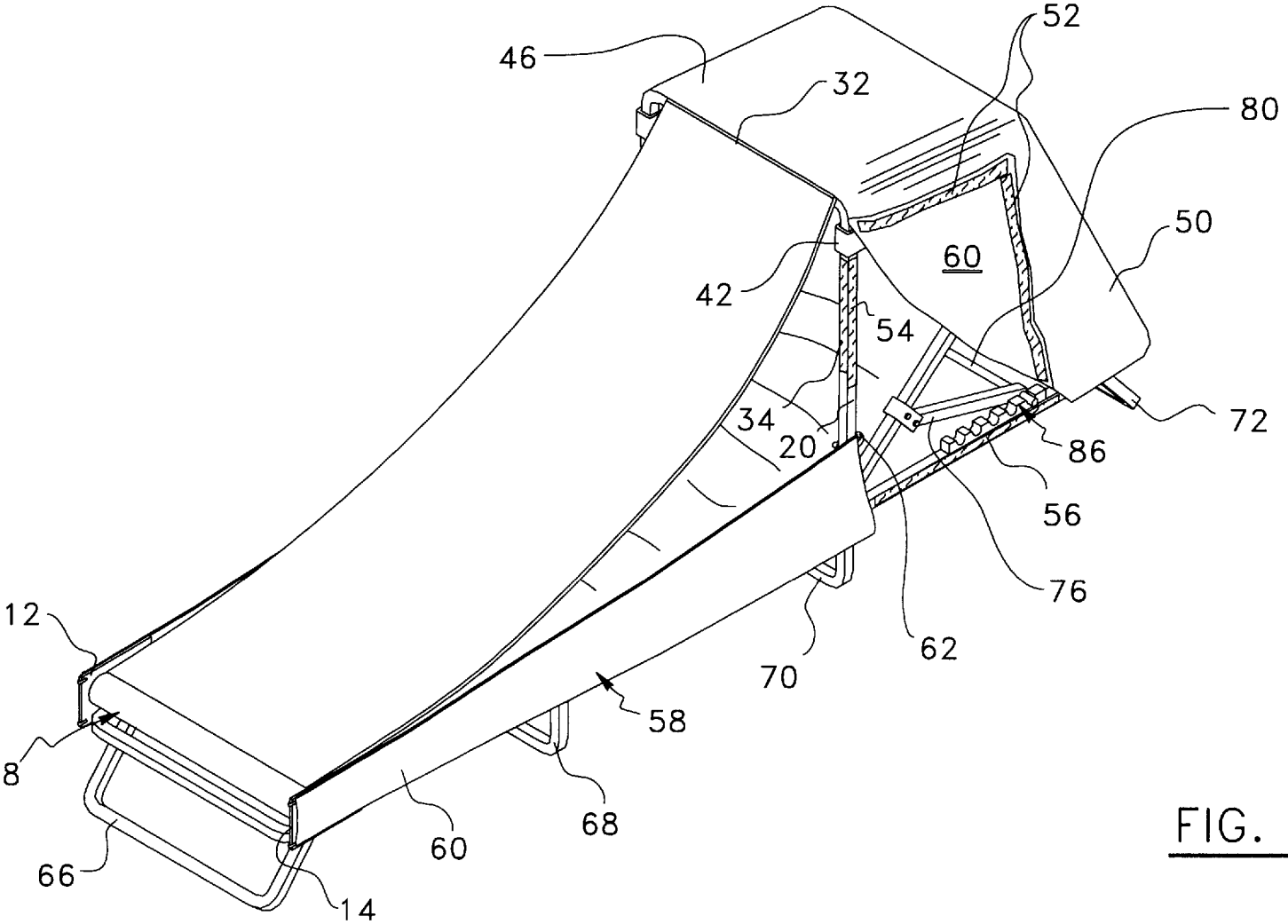
FIG. 3 is a perspective view illustrating a deck chair provided with a cover assembly according to the present invention, where the accessories of the cover assembly are in use.

The support pole 20 can thus be upwardly mounted onto the chair framework at a remote location away from the roll of fabric 8. The upper part of the support pole 20 is shaped to provide at least one attachment point for a free end 32 of an unrolled part of the fabric 8 (as shown in FIG. 3), at a desired height above the chair framework. Since the purpose of the support 19 is to provide such an attachment point for the free end 32 of the fabric 8, the support 19 could take many other shapes. For example, it could consist of two straight poles upwardly mounted onto respective sides of the chair framework, with the upper portions of the straight poles providing the required attachments points. It could also consist of a single straight pole upwardly mounted on one side of the framework, provided with a cantilever pole connected to an upper end of the straight pole and extending over the chair framework. Instead of using cotters 29 and bores, the mounting brackets 22, 24 could be easily arranged to form vises that clamp the lower ends of the support pole 20 between the plates of the brackets 22, 24, in order to hold the support pole 20 in position. Such a vise arrangement could be especially useful to permit an angle adjustment of the support pole 20 with respect to the chair framework.

Many manners can be adopted to detachably attach the free end 32 of the fabric 8 to the upper part of the support 19. For example, VELCRO (synthetic materials which adhere when pressed together) elements 34 can be positioned at the desired height onto the upper part of the support pole 20 to fasteningly receive corresponding VELCRO elements 36 at the free end 32 of the fabric 8.

Figure 5:
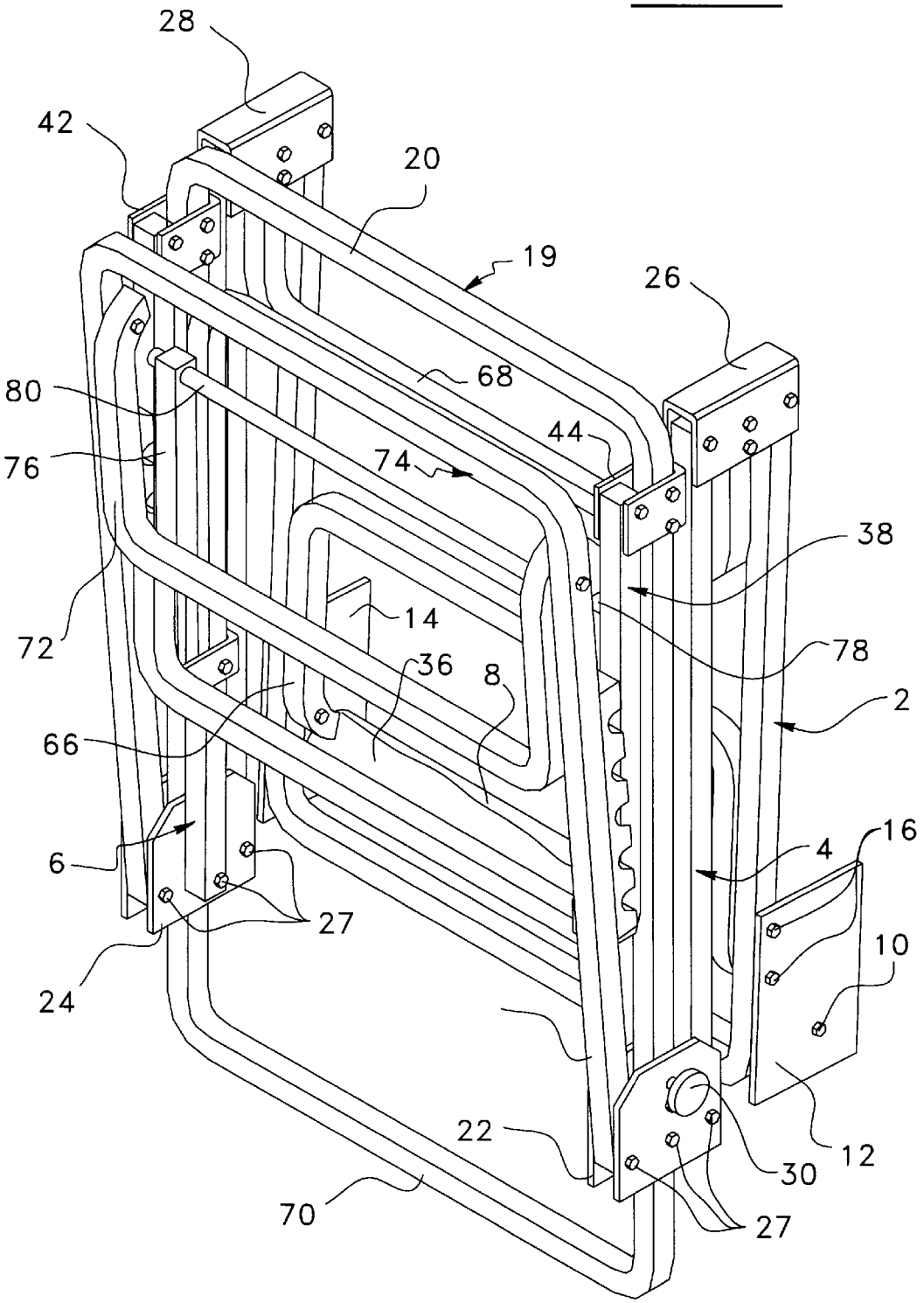
FIG. 5 is a perspective view of the deck chair as shown in FIG. 1, in a folded compact arrangement for transportation or storage.

An optional roof accessory 38 may be affixed to the cover assembly to cover the back rest portion 6, and provide the user with additional shade or rain protection. The roof accessory 38 includes a U-shaped roof pole 40 having front ends pivotally connected to the upper part of the support pole 20 on a back side thereof, by means of hinge brackets 42, 44. These hinge brackets 42, 44 permit the deployment and holding of the roof pole 40 perpendicularly to the upper part of the support pole 20 when in use, and its folding next to the support pole 20 for transportation and storage of the deck chair, as shown in FIG. 5.

Referring to FIG. 3, the roof accessory 38 has a top fabric 46 covering an area delimited by the roof pole 40. The top fabric 46 is detachably fastened on the roof pole 48 by means for example of VELCRO strips 48 (shown in FIG. 1).

The roof accessory 38 may conveniently further include a side screen of fabric 50 laterally covering an area extending behind the support pole 20, between the roof pole 40 and the framework under the roof pole 40, around the back rest portion 20, to provide lateral wind protection at the level of the back rest portion 6. The side screen of fabric 50 can be detachably connected to these structural elements by means of VELCRO strips 52, 54, 56, so that side flaps 60 can be doubled over for air circulation or to talk to a neighbour.

Optional side accessories 58 can be provided to protect the user from lateral wind at the level of the leg rest and seat portions 2, 4. The side accessories 58 are formed of screens of fabric 60 hanged by elastic cords having ends provided with hooks 62 for detachable attachment to the support pole 20 at a desired height thereon and to the front end of the leg rest portion 2 on respective sides of the chair framework.

Figure 4:
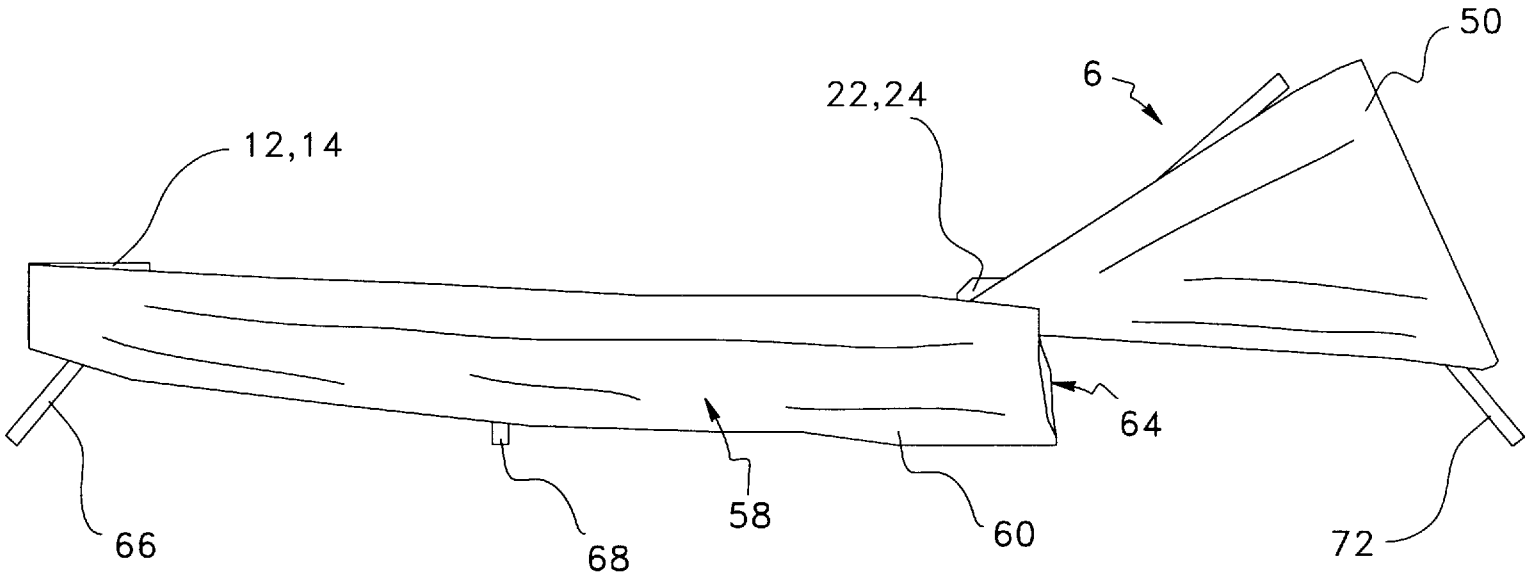
FIG. 4 is a side elevation view of the deck chair as shown in FIG. 3, where the accessories of the cover assembly are in withdrawn position.

Referring to FIG. 4, there is shown the deck chair where the accessories 38, 58 of the cover assembly are in withdrawn position. The side accessories 58 can be used as pockets 64 when attached at the level of the chair framework.

Preferably although not restrictively, the fabric used in the cover assembly is canvas that can be provided with optional windows.

Referring to FIG. 1, the leg rest, seat and back rest portions 2, 4, 6 of the framework are formed of tubular members interconnected by means of hinge brackets 22, 24, 26, 28 so that the leg rest and back rest portions 2, 6 are foldable over the seat portion 4. The framework is provided with U-shaped tubular legs 66, 68, 70, 72 having ends pivotally connected to the hinge brackets 22, 24, 26, 28, the roll supporting brackets 12, 14, and a tubular head portion 74 of the framework for downward deployment. The back rest portion 6 is locked in a fixed angular position with respect to the head portion 74 by means of a pair of parallel arms 76, 78 having upper ends pivotally connected to the back rest portion 6 on respective sides thereof, and lower ends between which a transversal rod 80 extends. The transversal rod 80 has extended ends 82, 84 projecting beyond the arms 76, 78 which are inserted in two series of upwardly directed notches 86, 88 provided on respective sides of the head portion 74. The notches 86, 88 can be provided with suitable locking elements (not shown in the Figures) to prevent unwanted removal of the extended ends 82, 84 therein.

Referring to FIG. 5, there is shown the deck chair with the cover assembly, in a compact folded arrangement. The chair can be carried just like a briefcase, using the roll of fabric 8 as a handle. Thus, a user can bring the folded deck chair to the beach instead of a parasol and/or a regular deck chair. In the compact arrangement, the leg rest portion 2 is folded about the brackets 26, 28, and placed next to the seat portion 4 which is itself folded about the mounting brackets 22, 24 and placed next to the support pole 20 of the support 19. The arms 76, 78 and transversal rod 80 are folded next to the back rest portion 6 which is itself folded in alignment with and inside the support pole 20. The roof accessory 38 is folded about the brackets 42, 44 next to the support pole 20. Finally, the head portion 74 is folded about the mounting brackets 22, 24 next to the roof accessory 38, with the legs also folded inside the head portion 74.

While embodiments of this invention have been illustrated in the accompanying drawings and described above, it will be evident to those skilled in the art that changes and modifications may be made therein without departing from the essence of this invention. All such modifications or variations are believed to be within the scope of the invention as defined by the claims appended hereto.

What is claimed is:

1. A cover assembly with a deck chair having an elongated chair framework with adjoining leg rest, seat and back rest portions, comprising:

a roll of material which is adapted to be unrolled and stretched over the chair framework, and is adapted to form an enclosed volume for protectively covering a user lying down on the leg rest, seat and back rest portions;

means for rotatably mounting the roll of material and for attaching said roll onto a front end of the leg rest portion, transversely with respect to the chair framework;

a foldable support having a base provided with means for substantially upwardly mounting the support for attachment onto the chair framework at a remote location away from the roll of material, and an upper part shaped to provide at least one attachment point for a free end of an unrolled part of the material, at a desired height above the chair framework, the support being a U-shaped support pole having lower ends forming the base of the support adapted to attach to respective sides of the chair framework, said means for mounting the support include a pair of mounting brackets having lower and upper portions, the mounting brackets being provided with means for securing the lower portions of the mounting brackets onto respective sides of the framework at or near the junction of the seat portion with the back rest portion, the lower ends of the support pole being pivotally mounted onto the upper portions of the mounting brackets, means for locking the support pole in a fixed angular position with respect to the seat portion; and means for attaching the free end of the material to the upper part of the support.

2. The cover assembly according to claim 1, wherein the means for rotatably mounting include:

a pair of roll supporting brackets having upper and lower portions, the roll supporting brackets being provided with means for securing and adapting to attach lower portions of the roll supporting brackets onto respective sides of the framework at the front end of the leg rest portion; and a rotatable shaft adapted to receive the roll of material, the shaft being mounted between the upper portions of the roll supporting brackets.

3. The cover assembly according to claim 2, wherein the shaft is provided with a rewind mechanism causing the roll of material to automatically rewind when detached from the attachment point.

4. The cover assembly according to claim 3, further comprising:

a roof accessory adapted to cover the back rest portion, the roof accessory including:

a U-shaped roof pole having front ends provided with means for mounting the roof pole substantially perpendicularly to the upper part of the support on a back side thereof; and a top material adapted to cover an area delimited by the roof pole; and means for detachably fastening the top material to the roof pole;

and side accessories including:

a pair of cords;

means for attaching the cords between the support at a desired height thereon and the front end of the leg rest portion on respective sides of the chair framework; and two screens of material extending between the cords and the framework on respective sides thereof, the screens of material being detachably connected to the cords;

and wherein:

the support is a U-shaped support pole having lower ends forming the base of the support on respective sides of the chair framework;

the means for attaching comprise:

synthetic attachment elements extending at the free end of the material; and corresponding synthetic attachment elements positioned at the desired height onto an upper part of the support pole to fasteningly receive the synthetic attachment elements at the free end of the material;

the means for mounting the support include:

a pair of mounting brackets having lower and upper portions, the mounting brackets being provided with means for securing the lower portions of the mounting brackets onto respective sides of the framework at or near the junction of the seat portion with the back rest portion, the lower ends of the support pole being pivotally mounted onto the upper portions of the mounting brackets; and means for locking the support pole in a fixed angular position with respect to the seat portion;

the means for locking comprise:

coaxially alignable bores through the lower ends of the support pole and the upper portions of the mounting brackets, shifted from a pivot axis of the support pole with respect to the mounting brackets; and a pair of cotters insertable into the bores to lock the angular position of the support pole with respect to the mounting brackets secured to the framework;

the roof accessory further includes:

a side screen of material adapted to laterally cover an area extending behind the support pole, between the roof pole and the framework under the roof pole, and around the back rest portion; and means for detachably fastening the side screen of fabric to the roof pole, the framework under the roof pole, and the support pole;

the means for mounting the roof pole include hinge brackets pivotally mounting the roof pole to the support pole;

the means for attaching comprise hooks provided at ends of the cords;

the cords are elastic; and the material is canvas.

5. The cover assembly according to claim 1, wherein the means for attaching comprise:

synthetic attachment elements extending at the free end of the material; and corresponding synthetic attachment elements positioned at the desired height onto an upper part of the support pole to fasteningly receive the synthetic attachment elements at the free end of the material.

6. The cover assembly according to claim 1, wherein the means for locking comprise:

coaxially alignable bores through the lower ends of the support pole and the upper portions of the mounting brackets, shifted from a pivot axis of the support pole with respect to the mounting brackets; and a pair of cotters insertable into the bores to lock the angular position of the support pole with respect to the mounting brackets secured to the framework.

7. The cover assembly according to claim 1, further comprising:

a roof accessory adapted to cover the back rest portion, the roof accessory including: a U-shaped roof pole having front ends provided with means for mounting the roof pole substantially perpendicularly to the upper part of the support on a back side thereof;

a top material adapted to cover an area delimited by the roof pole; and means for detachably fastening the top material to the roof pole.

8. The cover assembly according to claim 7, wherein the roof accessory further includes:

a side screen of material adapted to laterally cover an area extending behind the support pole, between the roof pole and the framework under the roof pole, and around the back rest portion; and means of detachably fastening the side screen of material to the roof pole, the framework under the roof pole, and the support pole.

9. The cover assembly according to claim 7, wherein the means for mounting the roof pole include hinge brackets pivotally mounting the roof pole onto the support pole.

10. The cover assembly according to claim 1, further comprising side accessories including:

a pair of cords;

means for attaching the cords between the support at a desired height thereon and the front end of the leg rest portion on respective sides of the chair framework; and a pair of screens of material extending between the cords and the framework on respective sides thereof, the screens of material being detachably connected to the cords.

11. The cover assembly according to claim 10, wherein the means for attaching comprise hooks provided at ends of the cords.

12. The cover assembly according to claim 10, wherein the cords are elastic.

13. The cover assembly according to claim 1, wherein the material is canvas.

14. A deck chair comprising:

an elongated chair framework with adjoining leg rest, seat and back rest portions, said leg rest, seat and back rest portions being formed of tubular members, and the chair framework including hinge brackets interconnecting the tubular members of the leg rest, seat and back rest portions so that the leg rest and back rest portions are foldable over the seat portion, U-shaped tubular legs having ends pivotally connected to the hinge brackets for downward deployment with respect to the chair framework;

a cover assembly including:

a roll of material which, when unrolled and stretched over the chair framework, is adapted to form an enclosed volume for protectively covering a user lying down on the leg rest, seat and back rest portions;

means for rotatably mounting the roll of material onto a front end of the leg rest portion, transversely with respect to the chair framework;

a foldable support having a base provided with means for substantially upwardly mounting the support onto the chair framework at a remote location away from the roll of material, and an upper part shaped to provide at least one attachment point for a free end of an unrolled part of the material, at a desired height above the chair framework; and means for attaching the free end of the material to the upper part of the support.

15. The deck chair according to claim 14, wherein the chair framework has:

a tubular head portion pivotally connected to the hinge brackets between the seat and back rest portions; and locking means for locking the back rest portion in a fixed angular position with respect to the head portion.

16. The deck chair according to claim 15, wherein the locking means include:

a pair of parallel arms having upper ends pivotally connected to the back rest portion on respective sides thereof, and lower ends;

a transversal rod extending between the lower ends of the arms, and having extended ends projecting beyond the arms; and two series of upwardly directed notches provided on respective sides of the head portion, to receive the extended ends of the transversal rod.

17. The deck chair according to claim 14, wherein:

the cover assembly further comprises:

a roof accessory to cover the back rest portion, the roof accessory including:

a U-shaped roof pole having front ends provided with means for mounting the roof pole substantially perpendicularly to the upper part of the support on a back side thereof; and a top material adapted to cover an area delimited by the roof pole; and means for detachably fastening the top material to the roof pole;

and side accessories including:

a pair of cords;

means for attaching the cords between the support at a desired height thereon and the front end of the leg rest portion on respective sides of the chair framework; and two screens of material extending between the cords and the framework on respective sides thereof, the screens of material being detachably connected to the cords;

the means for rotatably mounting include:

a pair of roll supporting brackets having upper and lower portions, the roll supporting brackets being provided with means for securing the lower portions of the roll supporting brackets onto respective sides of the framework at the front end of the leg rest portion; and a rotatable shaft adapted to receive the roll of material, the shaft being mounted between the upper portions of the roll supporting brackets, the shaft being provided with a rewind mechanism causing the roll of material to automatically rewind when detached from the attachment point;

the support is a U-shaped support pole having lower ends forming the base of the support on respective sides of the chair framework;

the means for attaching comprise:

synthetic attaching elements extending at the free end of the material; and corresponding synthetic attachment elements positioned at the desired height onto an upper part of the support pole to fasteningly receive the synthetic attachment elements at the free end of the material;

the means for mounting the support include:

a pair of mounting brackets having lower and upper portions, the mounting brackets being provided with means for securing the lower portions of the mounting brackets onto respective sides of the framework at or near the junction of the seat portion with the back rest portion, the lower ends of the support pole being pivotally mounted onto the upper portions of the mounting brackets; and means for locking the support pole in a fixed angular position with respect to the seat portion;

the means for locking comprise:

coaxially alignable bores through the lower ends of the support pole and the upper portions of the mounting brackets, shifted from a pivot axis of the support pole with respect to the mounting brackets; and a pair of cotters insertable into the bores to lock the angular position of the support pole with respect to the mounting brackets secured to the framework;

the roof accessory further includes:

a side screen of material adapted to laterally cover an area extending behind the support pole, between the roof pole and the framework under the roof pole, and around the back rest portion; and means for detachably fastening the side screen of material to the roof pole, the framework under the roof pole, and the support pole;

the means for mounting the roof pole include hinge brackets pivotally mounting the roof pole to the support pole;

the means for attaching comprise hooks provided at ends of the cords;

the cords are elastic; and the material is canvas.

* * * * *